US005946881A

United States Patent [19]

Chatelain

[11] Patent Number: 5,946,881

[45] Date of Patent: Sep. 7, 1999

[54] FORM FOR CASTING A CONCRETE FENCE POST IN SITU AND PROCESS FOR ITS USE

[76] Inventor: Paul J. Chatelain, 16009 Amber Valley, Whittier, Calif. 90602

[21] Appl. No.: 08/982,061

[22] Filed: Dec. 1, 1997

[51] Int. Cl.[6] ..... E04B 1/00

[52] U.S. Cl. ..... 52/741.14; 52/745.17; 249/51

[58] Field of Search ..... 249/17, 48, 50, 249/51; 52/723.1, 741.14, 745.17, 736.3, 737.4

[56] References Cited

U.S. PATENT DOCUMENTS

| | | | |
|---|---|---|---|
| 821,738 | 5/1906 | Pratt | 249/51 |
| 986,957 | 3/1911 | Wallin | 249/51 |
| 1,130,507 | 3/1915 | Hadley et al. | 249/51 |
| 3,588,027 | 6/1971 | Bowden | 249/48 |
| 4,624,439 | 11/1986 | Aguilera | 249/48 |
| 5,457,929 | 10/1995 | Kim | 52/723.1 |

FOREIGN PATENT DOCUMENTS

| | | | |
|---|---|---|---|
| 2660351 | 10/1991 | France | 249/48 |
| 462047 | 10/1968 | Switzerland | 52/741.14 |
| 899188 | 6/1962 | United Kingdom | 249/48 |

*Primary Examiner*—Michael Safavi
*Attorney, Agent, or Firm*—Edgar W. Averill, Jr.

[57] ABSTRACT

A form for casting a concrete fence post in place and the process of using the form. The form has elongated first and second halves, each having outwardly extending flanges which are attached together to form a cavity in the shape of a finished fence post. The form halves are either slightly tapered or fastened by fasteners which may be loosened so that the form can be easily lifted off the resulting cured concrete post. The process for using the form includes the steps of placing the post form over a post hole and pouring wet concrete into the top of the post form. The wet concrete is allowed to cure and then the post form is lifted off the cured post. The lifting step may be carried out with assistance of a jack and/or by loosening the fasteners which hold the two halves together.

11 Claims, 5 Drawing Sheets

FORM FOR CASTING A CONCRETE FENCE POST IN SITU AND PROCESS FOR ITS USE

BACKGROUND OF THE INVENTION

The field of the invention is fencing and the invention relates more particularly to the making of fence posts. Applicant's U.S. Pat. No. 5,580,480 discloses a metal hinged post form similar in some ways to the present post form.

Applicant's earlier post form was removed by opening the form at a hinge. There are several difficulties with the use of a hinged metal post form. One difficulty is the solidifying of concrete at the base of the form. This can make it difficult to open the form after the concrete is set. Another difficulty is the expense of fabricating such a form. A still further difficulty is the weight of a fabricated steel form. Fiber board forms for concrete posts are well known in the building trade. One such form has been sold for many years under the trademark "Sonotube." Such forms are removed by cutting and turning them off of the cured post. The use of such forms is thus too expensive for the making of fence posts since they are a one-use only form and are relatively expensive. There is, thus, a need for a more economical easier-to-remove form for casting a fence post in situ.

BRIEF SUMMARY OF THE INVENTION

It is an object of the present invention to provide a lightweight, low cost fence post form and to provide a process for removing the form from a cured concrete post.

The present invention is for a form for casting a concrete fence post in situ. The form has an elongated first and second half. Each half has a flange of at least about 1" in width and a half cavity therebetween. The first and second halves are attached along their flanges to form a rounded rectangular cavity. In one embodiment, the form is tapered with the smaller portion of the tapered cavity at the top of the form and the larger portion at the bottom of the form. In another embodiment, the halves are not tapered, but are attached by fasteners which can be loosened to assist in lifting the form from a cured concrete post. In a third embodiment, the form is a one piece member with a pair of flanges along one side. The rounded rectangular shape of a finished post permits the attachment of a cross member or other attachment means to the faces thereof. Also, holes may be formed through the wet concrete which provides holes in the cured concrete post.

Preferably the form is fabricated from a polymer and is about 61'" in length. Other lengths can, of course, be used, depending on the height of the desired finished post.

The process for using the post form involves the following steps: First, a post hole is dug in the earth. Wet concrete is placed in the post hole. Next, a reinforcing member is placed over the post hole and into the wet concrete. Then, an assembled post form is placed over the reinforcing member. Pegs may be placed through holes in the form. Next, wet concrete is poured into the top of the form filling the form. Preferably the wet concrete is settled by tapping the outside of the post form. Next, the wet concrete is permitted to set to form a solid contained post having a top surface. The pegs are then removed forming holes through the cured concrete post. When a tapered form is used, the post form is lifted up by pressing down on top of the concrete post and lifting up on the form. For instance, a jack is placed on the top surface of the cured concrete, the base of the jack being supported by the top surface of the concrete. The top of the jack is then attached to the form and the jack extended, thereby pulling the form off of the post. Preferably the jack is tied to both of the flanges.

In a second embodiment, the fasteners holding adjacent flanges together are loosened after the concrete is cured and the form lifted off.

DESCRIPTION OF THE PREFERRED EMBODIMENTS

Figure 1:
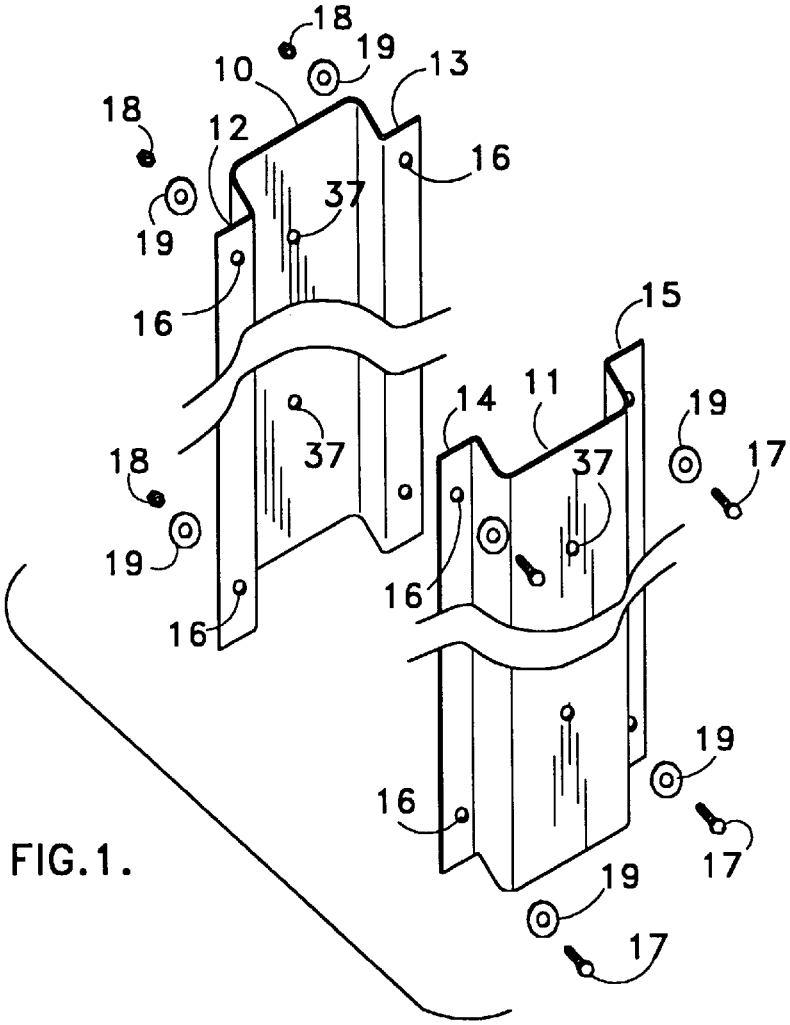
FIG. 1 is an exploded perspective view of the post form of the present invention.

FIG. 1 shows an exploded perspective view of a first embodiment of the post form of the present invention. The post form has two identical halves 10 and 11. Each half has two flanges 12, 13, 14 and 15. Each flange has a plurality of holes 16 for the attachment of bolts. Bolts 17 and washers 19 are shown on one side of the exploded form and nuts 18 and washers 19 are shown on the other side of the form. Other attachment means such as clamps can be used in place of nuts and bolts as a means for removably attaching the two identical halves together.

The form is preferably fabricated from a polymer such as ABS. The thickness of the ABS may be about ⅛" although thinner or thicker panels may be used. The form is preferably vacuum formed, but may be injection molded, rotationally cast, blow molded, or extruded. Each form may have a number of holes 37 which may be used for the insertion of pegs to form holes through the cast fence post. This may be used for the attachment of any appropriate objects.

Figure 2:
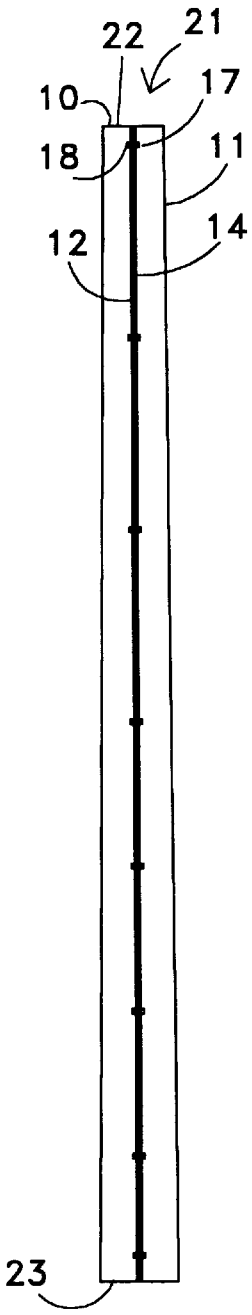
FIG. 2 is a side view of the assembled post form.

The post form is shown in an assembled side view in FIG. 2. The post form can, of course, be shipped with two nested halves to reduce the container size with the nuts, bolts and washers contained in a separate bag. The assembled post form is indicated by reference character 21, the top by 22 and the bottom by 23.

Figure 3:
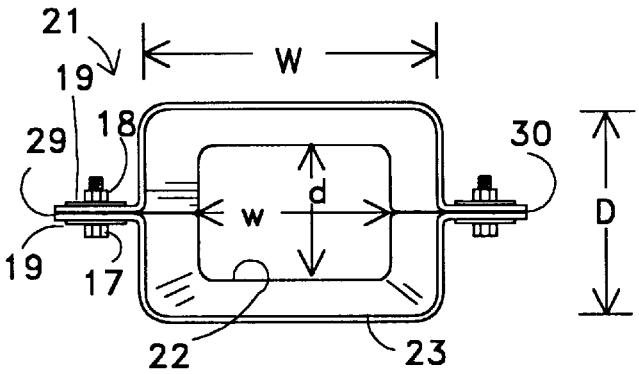
FIG. 3 is a bottom view of the assembled post form of FIG. 2.

The post form of FIGS. 1 through 10 is a tapered post form. A bottom view of the post form is shown in FIG. 3 where the amount of taper is shown. The inside width at the bottom is indicated by reference character "W" and the depth by "D". The inside width at the top of the form is indicated by "w" and the depth at the top of the form is indicated by "d". These dimensions depend on the size of the finished form but it has been found that the following dimensions are useful:

| | |
|---|---|
| W = 6.5" | w = 5.5" |
| D = 4.5" | d = 3.5" |

By tapering the form, the removal of the form from a set concrete post is greatly facilitated.

Figure 4:
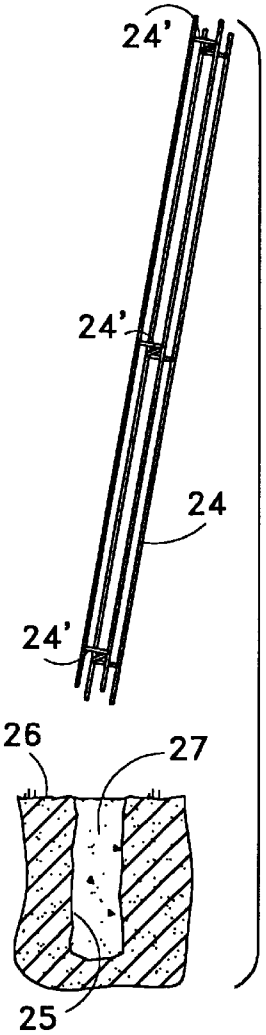
FIG. 4 is an exploded front view, partly in cross section, showing a reinforcing cage over a post hole filled with wet concrete.

The process of the present invention as applied to a tapered post form is indicated in FIGS. 4 through 11. In FIG. 4, a post hole 25 has been dug in a conventional manner in the earth 26 and it has been filled with wet concrete 27. A reinforcing cage 24 consists of four elongated members held together with three Z-shaped cross members 24'.

Figure 5:
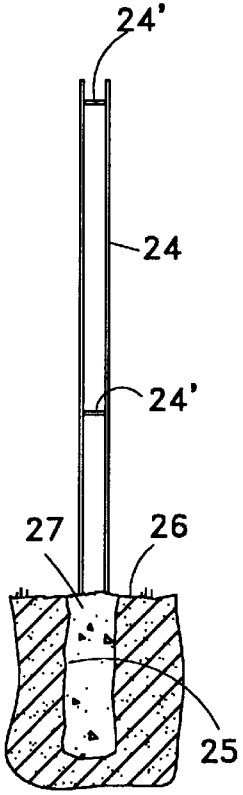
FIG. 5 is a front view of the reinforcing cage placed into the wet concrete filled post hole of FIG. 4.

The reinforcing cage 24 has been inserted to the bottom of post hole 25, its bottom part being immersed in the wet concrete 27 as shown in FIG. 5. The wet concrete 27 has sufficient strength to hold the reinforcing cage 24 in a desired vertical position.

An assembled form 21 is shown above the vertical reinforcing cage 24. Its bottom end 23 is placed over the top of the cage 24 and is moved downwardly until it rests against the ground 26. Three openings 37 are formed in each half to permit the insertion of pegs which are removed after the concrete has cured to form three holes 37' in the cured concrete post 36.

Figure 7:
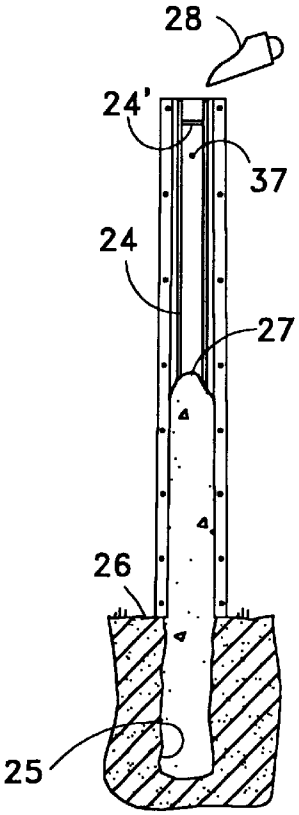
FIG. 7 is a cross-sectional front view of the post form of FIG. 6 above the post hole including a reinforcing piece and showing the form partly filled with wet concrete.
Figure 6:
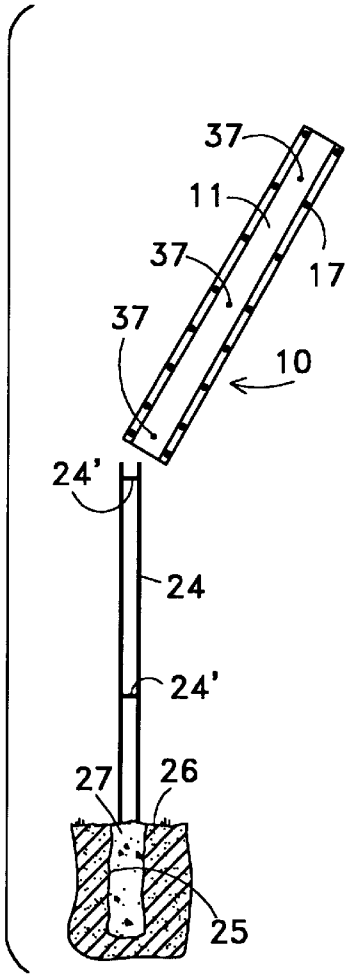
FIG. 6 is an exploded front view of an assembled post form being placed over the reinforcing cage shown in FIG. 5.
Figure 8:
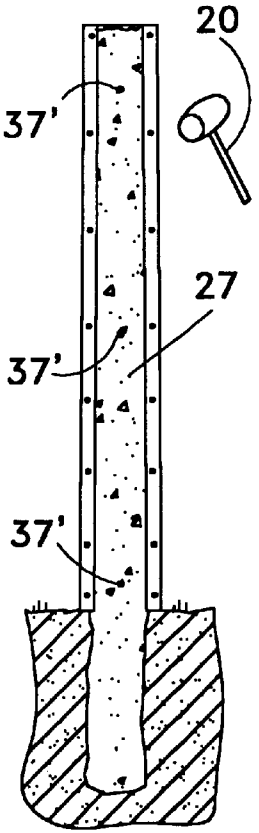
FIG. 8 is a front view analogous to FIG. 6, except that the wet concrete has completely filled the post form and a mallet is shown which may be tapped against the form to settle the concrete.

The assembled form is shown in cross-sectional view in FIG. 7 and only form half 10 is depicted. In FIG. 7, wet concrete is poured into the form. A scoop 28 may be used for this purpose. As shown in FIG. 8, a rubber mallet 20 may be used to tap the outside of the form after it is filled with wet concrete to settle the concrete. This tapping purges any air out of the wet concrete. There is actually a small space between the flanges indicated by reference characters 29 and 30 in FIG. 3 which permits excess water to escape from the wet concrete 27. Next the wet concrete 27 is allowed to set.

Figure 11:
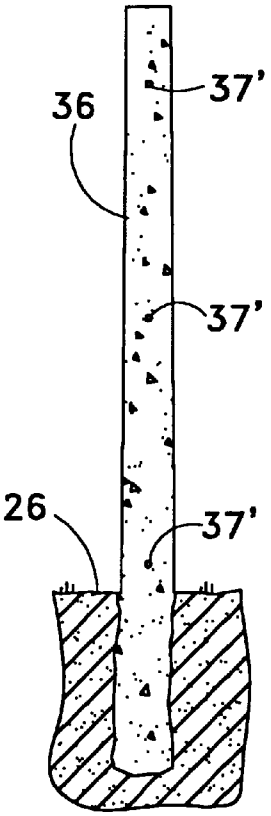
FIG. 11 is a front view of a cured concrete post.
Figure 10:
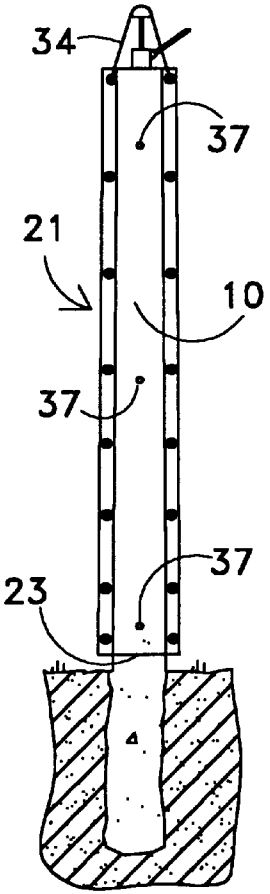
FIG. 10 is a view analogous to FIG. 9, except that the jack has lifted the form a short distance from the cured concrete post.
Figure 9:
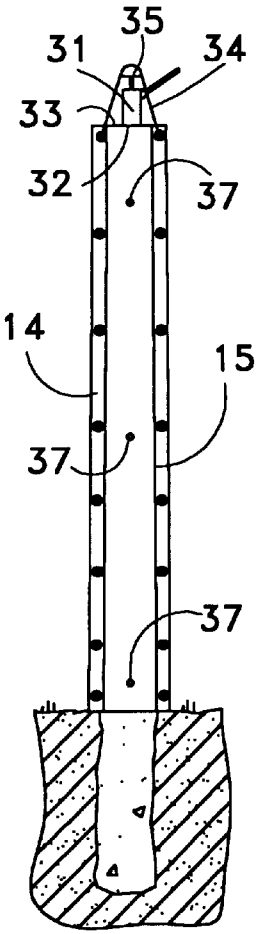
FIG. 9 is a front view of the post form of FIG. 4 filled with set concrete and showing a jack supported on the top.

After the concrete has set, typically after one day, the pegs are removed and a hydraulic jack 31, or other lifting means, is placed with its bottom 32 on the top 33 of the set post form as shown in FIG. 9. A line 34 is secured to the top one or two fasteners of each flange and over the top 35 of jack 31. This line, preferably a length of webbing can remain attached to the form after it has been assembled. The jack 31 is then extended which lifts the form free from the set concrete post as shown in FIG. 10. Because the post form is tapered, as is of course the concrete post, it only takes several inches of lift to break the form free. The form may then be easily lifted off of the cured concrete post. The resulting cured post is shown in FIG. 11 and indicated by reference character 36. The cured post 36 has three holes 37' formed through it. The form is, of course, completely reusable and very easy to use.

Figure 12:
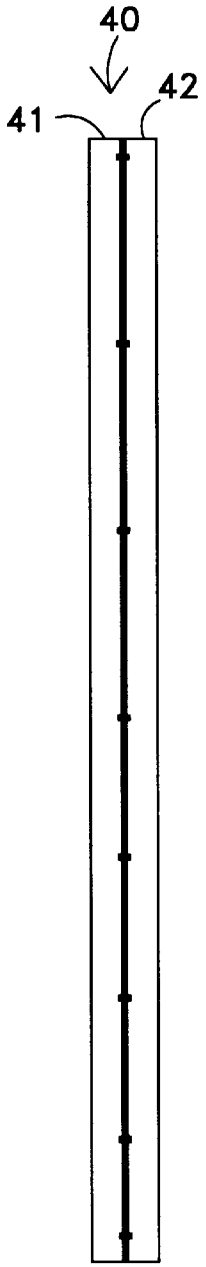
FIG. 12 is a side view of an alternate embodiment of the post form of the present invention.
Figure 14:
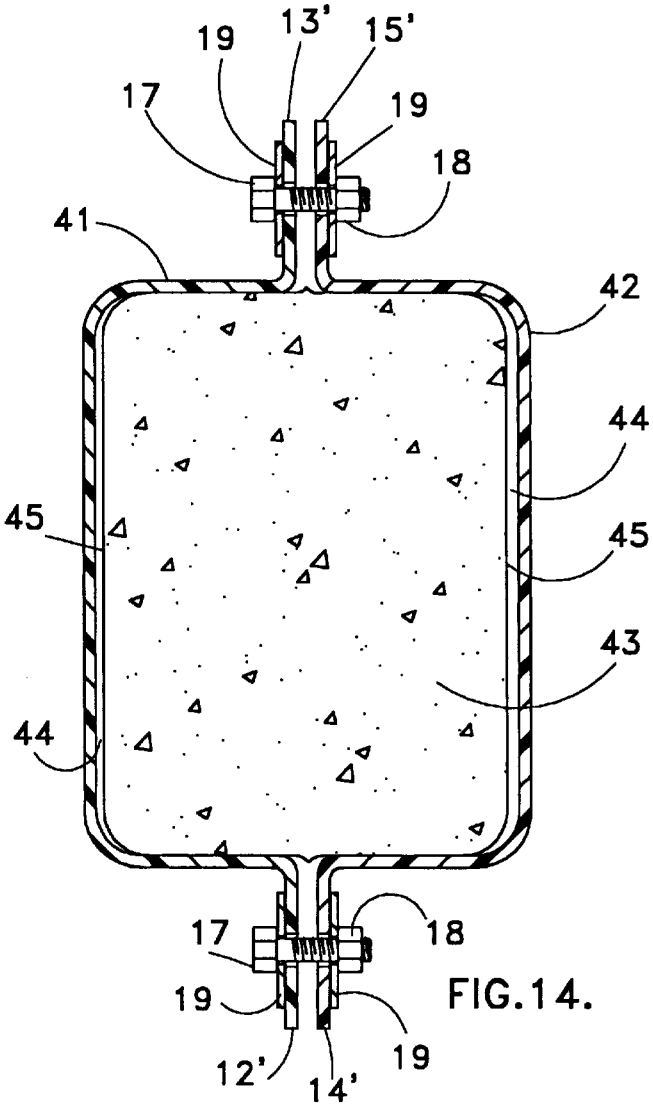
FIG. 14 is a cross-sectional view taken along line 14—14 of FIG. 13 showing the post form of FIG. 12 loosened around a cured concrete post.
Figure 15:
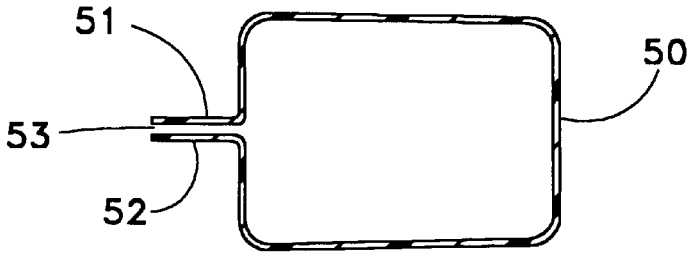
FIG. 15 is a cross-sectional top view of an alternate embodiment of the post form of FIG. 2.
Figure 16:
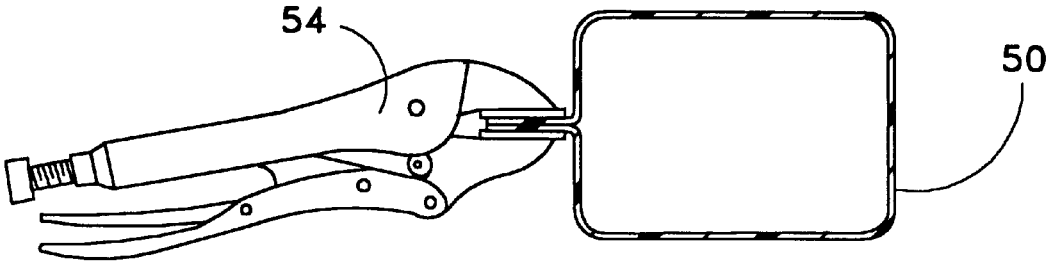
FIG. 16 is a view analogous to FIG. 15 except that the post form is held in a closed configuration.
Figure 17:
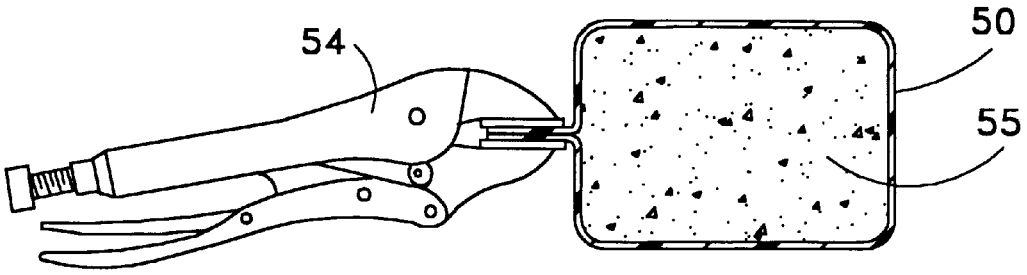
FIG. 17 is a view analogous to FIG. 16 except that the form is filled with concrete.
Figure 18:
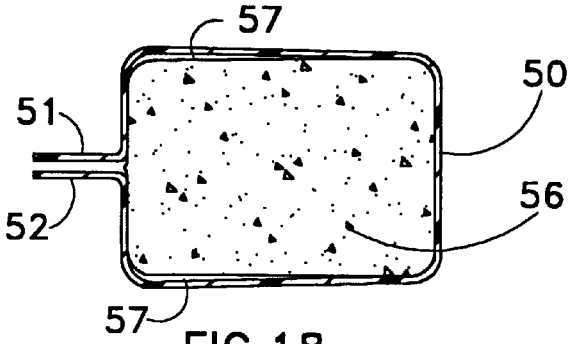
FIG. 18 is a view analogous to FIG. 17 except that the form is in an open configuration.

An alternate method of removing the post form is indicated in FIG. 14 of the drawings. This post form, indicated by reference character 40 in FIG. 12, is assembled from halves 41 and 42 which are very similar to halves 10 and 11, except that there is no taper in the form. In this configuration it is essential that the fasteners can be loosened or removed. In the tapered post form it would be possible to use rivets or other permanent attachment means, although, of course it is possible to use the nuts, bolts and washers shown best in FIG. 1 of the drawings.

These same fasteners are shown in FIG. 14 and as in FIG. 1 are indicated by reference characters 17, 18 and 19. The flanges of form halves 41 and 42 are indicated by reference characters 12' and 13' and 14' and 15' respectively. Instead of nuts and bolts, clamps or a snap-on channel can be used to removably hold the flanges together.

Figure 13:
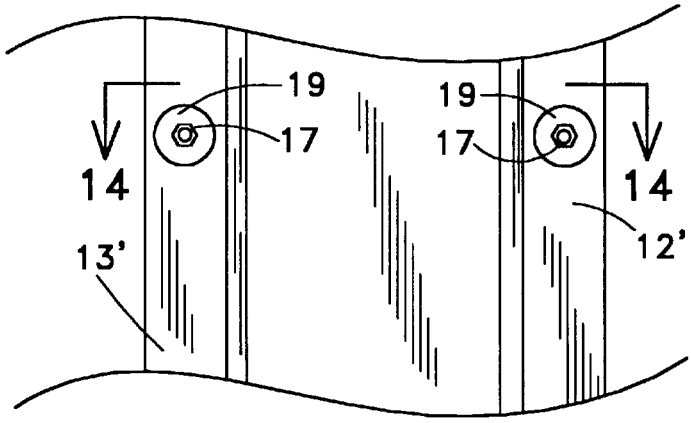
FIG. 13 is a front view of a portion of the post form of FIG. 12.

A front view of the assembled post form is shown in FIG. 13 where the washers 19 and nuts 17 are shown in front view. It is appropriate to use a relatively large washer with the assembled post form so that the force of the nut 17 may be spread out over essentially the full width of the flanges. It has been found that ¼" nuts and bolts used with 1¼" washers provide an appropriate fastening member. The flanges in the preferred embodiment shown in the drawings are 1¾" in width. The post form itself may be made from a polymer as then as about ⅛".

Returning to the method of removing the post form of FIG. 12, the loosened form is shown over a cured post 43 in FIG. 14. The nuts 18 have been loosened and a gap 44 is formed between the faces 45 of post 43 and the form. Because the form is slightly flexible, it may readily be lifted off of the cured concrete post once the fasteners have been loosened.

A one-piece form is shown in FIGS. 15, 16, 17 and 18. This form 50 has a pair of flanges 51 and 52 separated by a gap 53. This form may be economically extruded from a polymer. The form 50 is placed over a post hole, as is form 21 in FIG. 6. The gap 53 is reduced by clamps such as clamp 54. There is, however, still sufficient space between adjacent clamps for water to escape as the concrete is settled. Next, concrete 55 is poured into the open top of the vertical form. The concrete 55 is allowed to cure for a day to form a cured post 56. After curing the clamps are removed allowing flanges 51 and 52 to spread. This forms gaps 57 between the inner surface of the form and the outer surface of the cured concrete post. The loosened form may then be lifted off of the cured post.

The post form of the present invention may be easily used by do-it-yourselfers as well as professional contractors to form a concrete post in situ. The post is preferably reinforced to provide excellent strength. The concrete, of course, is free from damage by insects and free from rot. It also does not require the cutting down of any trees. The form being reusable is very economical.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A form for casting a concrete fence post in situ comprising:

an elongated first half form having a top, a bottom, a first elongated side and a second elongated side, fabricated from a polymer, said first half form having a first flange at least 1" in width along its first elongated side, a second flange at least 1" in width along its second elongated side and a half cavity therebetween; and an elongated second half form having a top, a bottom, a first elongated side and a second elongated side, fabricated from a polymer, having a first flange at least 1" in width along its first elongated side, a second flange at least 1" in width along its second elongated side and a half cavity therebetween, said second elongated form half being identical to said first elongated form half and being attached to said first elongated form half along the flanges thereof so that a cavity is formed between the first and second halves and so that a small space exists between the flanges sufficient in size to permit excess water to escape when wet concrete is poured in said cavity.

2. The form for casting a concrete fence post in situ of claim 1 wherein said elongated first half form and said second half form have a tapered half cavity therein.

3. The form for casting a concrete fence post in situ of claim 1 wherein the flanges of said first half and said second half are attached by fasteners which may be loosened.

4. The form for casting a concrete fence post in situ of claim 1 wherein said elongated first half form and said elongated second half form are bolted together along the flanges thereof.

5. The form for casting a concrete fence post in situ of claim 2 wherein said tapered cavity is about 6' in length and tapers from a size of about 3½" by 5½" at the top to a size of about 4½" by 6½" at the bottom.

6. The form for casting a concrete fence post in situ of claim 1 wherein said form is fabricated from a polymeric material about ⅛" thick.

7. A process for forming a cast concrete fence post in situ utilizing a post form and having a cavity with an opening at a top of the form and at a bottom of the form and a post form height comprising:

forming a post hole in the earth below a ground level;

pouring wet concrete into said post hole;

placing a metal reinforcing cage into the wet concrete so that it extends above the ground level to about the post form height;

placing said post form over said post hole so that the bottom of the form is about at the ground level and the reinforcing cage is within said cavity;

pouring wet concrete into a top of said post form to about fill said post form with wet concrete;

allowing said wet concrete to cure to a solidified state to form a solid, contained post; and removing said post form from said solid contained post.

8. The process of forming a cast concrete fence post in situ of claim 7 wherein said post form has at least one slit along the side thereof to permit any excess water to exit the form.

9. The process of forming a cast concrete fence post in situ of claim 7 wherein said post form has a tapered cavity and said post form is lifted from said solid, contained post having a top surface by pressing down on said top surface while lifting up on the tapered post form.

10. The process of forming a cast concrete fence post in situ of claim 7 further including the step of striking the side of the post form after said pouring step to cause any air to escape from the interior of said post form.

11. The process of forming a cast concrete fence post in situ of claim 7 wherein said post form has two opposed flanges therealong, and said two opposed flanges are attached by at least one fastener which may be loosened after said allowing step to facilitate the removing of the form off the solid, contained post.

* * * * *